US005850732A

United States Patent [19]

Willis et al.

[11] Patent Number: 5,850,732

[45] Date of Patent: Dec. 22, 1998

[54] LOW EMISSIONS COMBUSTION SYSTEM FOR A GAS TURBINE ENGINE

[75] Inventors: Jeffrey W. Willis; Guillermo Pont, both of Los Angeles; Bruce L. Alder, Jr., Agoura, all of Calif.

[73] Assignee: Capstone Turbine Corporation, Tarzana, Calif.

[21] Appl. No.: 855,210

[22] Filed: May 13, 1997

[51] Int. Cl.[6] ..... F02G 3/00; F02C 3/08

[52] U.S. Cl. ..... 60/39.36; 60/760; 60/756

[58] Field of Search ..... 60/737, 738, 755, 60/756, 760, 39.36, 39.511

[56] References Cited

U.S. PATENT DOCUMENTS

| | | | |
|---|---|---|---|
| 3,866,413 | 2/1975 | Sturgess | 60/742 |
| 4,179,881 | 12/1979 | Faucher et al. . | |
| 4,586,328 | 5/1986 | Howald . | |
| 4,698,963 | 10/1987 | Taylor . | |
| 4,982,570 | 1/1991 | Waslo et al. . | |
| 4,996,838 | 3/1991 | Melconian . | |
| 5,025,622 | 6/1991 | Melconian . | |
| 5,099,644 | 3/1992 | Sabla et al. . | |
| 5,127,221 | 7/1992 | Beebe . | |
| 5,207,064 | 5/1993 | Ciokajlo et al. | 60/737 |
| 5,235,813 | 8/1993 | McVey et al. | 60/737 |
| 5,622,054 | 4/1997 | Tingle | 60/737 |
| 5,685,156 | 11/1997 | Willis | 60/760 |
| 5,735,126 | 4/1998 | Schulte-Werning | 60/755 |

*Primary Examiner*—Timothy S. Thorpe
*Assistant Examiner*—Ted Kim
*Attorney, Agent, or Firm*—Albert J. Miller

[57] ABSTRACT

A low emissions combustion system for a gas turbine engine, including a generally annular combustor with a plurality of tangential fuel injectors (14) to introduce a fuel/air mixture. The annular combustor includes a skirt shaped flow control baffle (48) from the inner liner and air dilution holes (50–54) in the inner liner underneath the flow control baffle and also in the cylindrical outer liner. The fuel injectors (14) extend through the recuperator housing and into the combustor through an angled tube and then through a tangential guide in the cylindrical outer liner of the combustor housing. The fuel injectors generally comprise an elongated injector tube with the outer end including a coupler having at least one fuel inlet tube. Compressed combustion air is provided to the interior of the elongated injector tube from either holes or slits therein which receive compressed air from the angled tube around the fuel injector which is open to the space between the recuperator housing and the combustor.

60 Claims, 12 Drawing Sheets

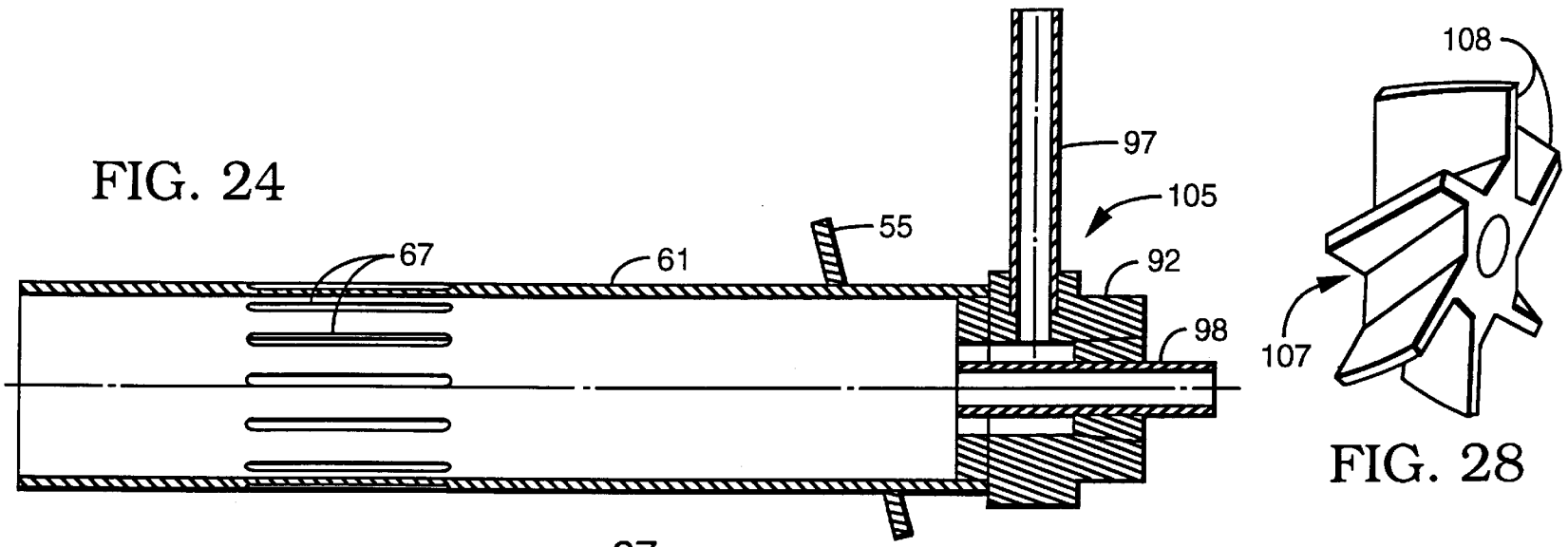
FIG. 24
FIG. 28
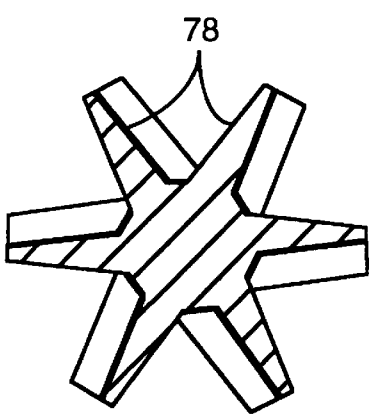
FIG. 27
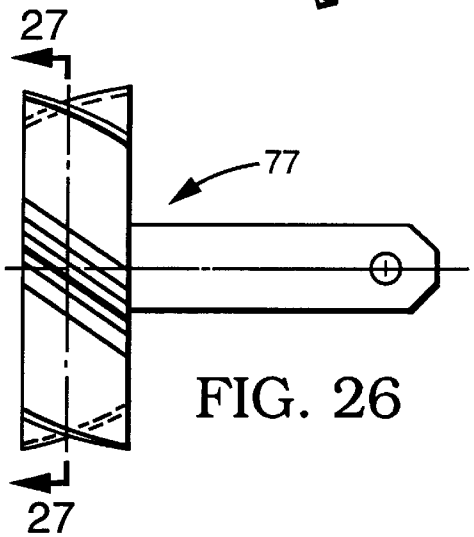
FIG. 26
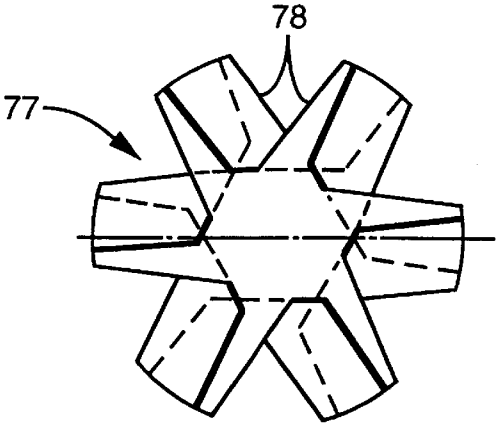
FIG. 25

LOW EMISSIONS COMBUSTION SYSTEM FOR A GAS TURBINE ENGINE

TECHNICAL FIELD

This invention relates to the general field of combustion systems and more particularly to an improved low emissions combustion system for a gas turbine engine.

BACKGROUND OF THE INVENTION

In a gas turbine engine, inlet air is continuously compressed, mixed with fuel in an inflammable proportion, and then contacted with an ignition source to ignite the mixture which will then continue to burn. The heat energy thus released then flows in the combustion gases to a turbine where it is converted to rotary energy for driving equipment such as an electrical generator. The combustion gases are then exhausted to atmosphere after giving up some of their remaining heat to the incoming air provided from the compressor.

Quantities of air greatly in excess of stoichiometric amounts are normally compressed and utilized to keep the combustor liner cool and dilute the combustor exhaust gases so as to avoid damage to the turbine nozzle and blades. Generally, primary sections of the combustor are operated near stoichiometric conditions which produce combustor gas temperatures up to approximately four thousand (4,000) degrees Fahrenheit. Further along the combustor, secondary air is admitted which raises the air-fuel ratio and lowers the gas temperatures so that the gases exiting the combustor are in the range of two thousand (2,000) degrees Fahrenheit.

It is well established that NOx formation is thermodynamically favored at high temperatures. Since the NOx formation reaction is so highly temperature dependent, decreasing the peak combustion temperature can provide an effective means of reducing NOx emissions from gas turbine engines as can limiting the residence time of the combustion products in the combustion zone. Operating the combustion process in a very lean condition (i.e., high excess air) is one of the simplest ways of achieving lower temperatures and hence lower NOx emissions. Very lean ignition and combustion, however, inevitably result in incomplete combustion and the attendant emissions which result therefrom. In addition, combustion processes cannot be sustained at these extremely lean operating conditions.

SUMMARY OF THE INVENTION

The low emissions combustion system of the present invention generally includes a generally annular combustor formed from a cylindrical outer liner and a tapered inner liner together with the combustor dome. A plurality of tangential fuel injectors introduce a fuel/air mixture at the combustor dome end of the annular combustion chamber. A generally skirt shaped flow control baffle extends from the tapered inner liner into the annular combustion chamber. A plurality of air dilution holes in the tapered inner liner underneath the flow control baffle introduce dilution air into the annular combustion chamber. In addition, a plurality of air dilution holes in the cylindrical outer liner introduces more dilution air downstream from the flow control baffle.

The fuel injectors extend through the recuperator housing and into the combustor through an angled tube which extends between the outer recuperator wall and the inner recuperator wall and then through a guide in the cylindrical outer liner of the combustor housing into the interior of the annular combustion chamber. The fuel injectors generally comprise an elongated injector tube with the outer end including a coupler having at least one fuel inlet tube. Compressed combustion air is provided to the interior of the elongated injector tube from either holes or slits therein which receive compressed air from the angled tube around the fuel injector which is open to the space between the recuperator housing and the combustor.

The fuel injector may include a concentric inner tube within the elongated injector tube and a centering ring, including a plurality of holes, may be disposed in the space between the concentric inner injector tube and the elongated injector tube. A variety of locations for the centering ring and the holes or slits in the outer injector tube are possible. The discharge end of the outer injector tube may also include a pilot flame holder or a swirler.

BRIEF DESCRIPTION OF THE DRAWINGS

Figure 1:
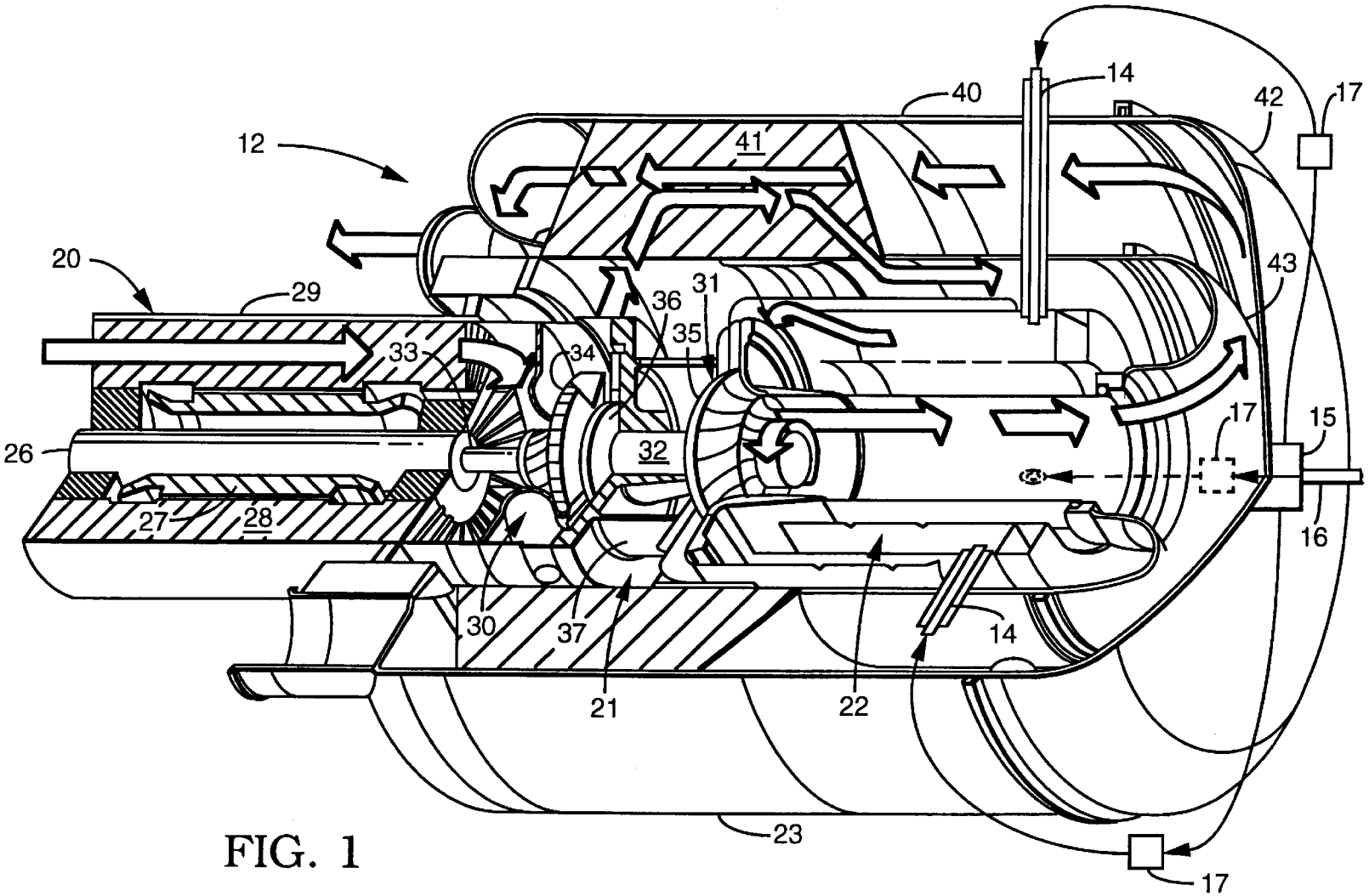
Figure 3:
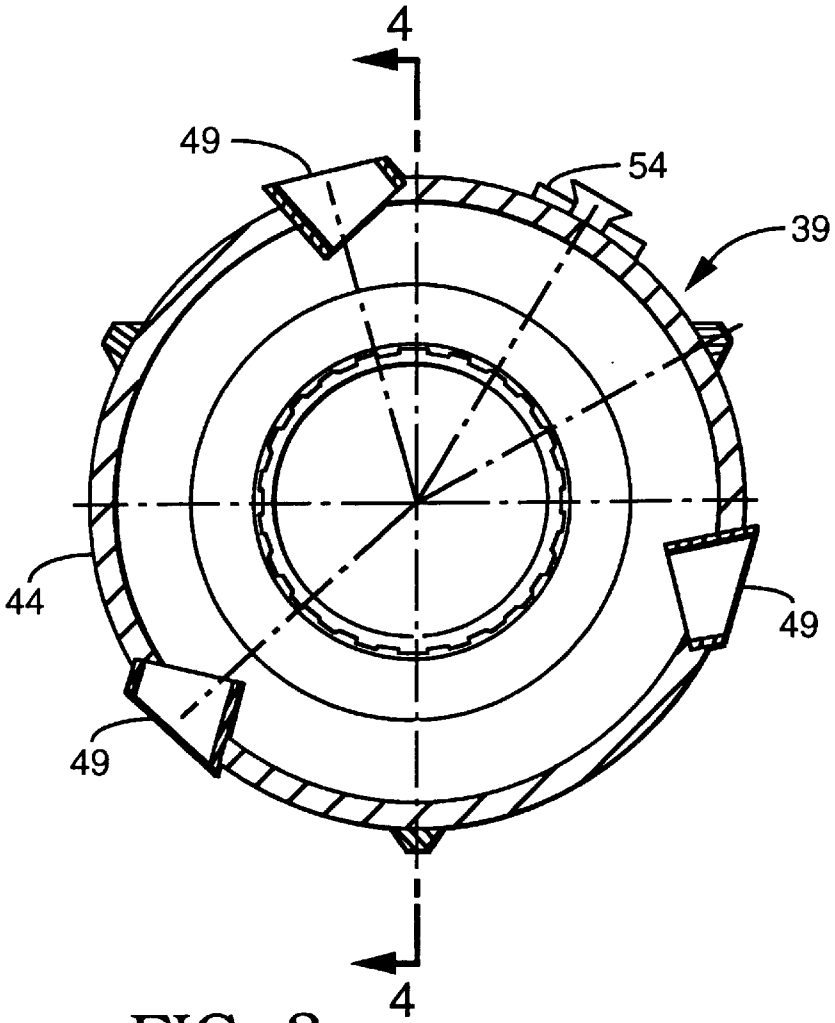
Figure 2:
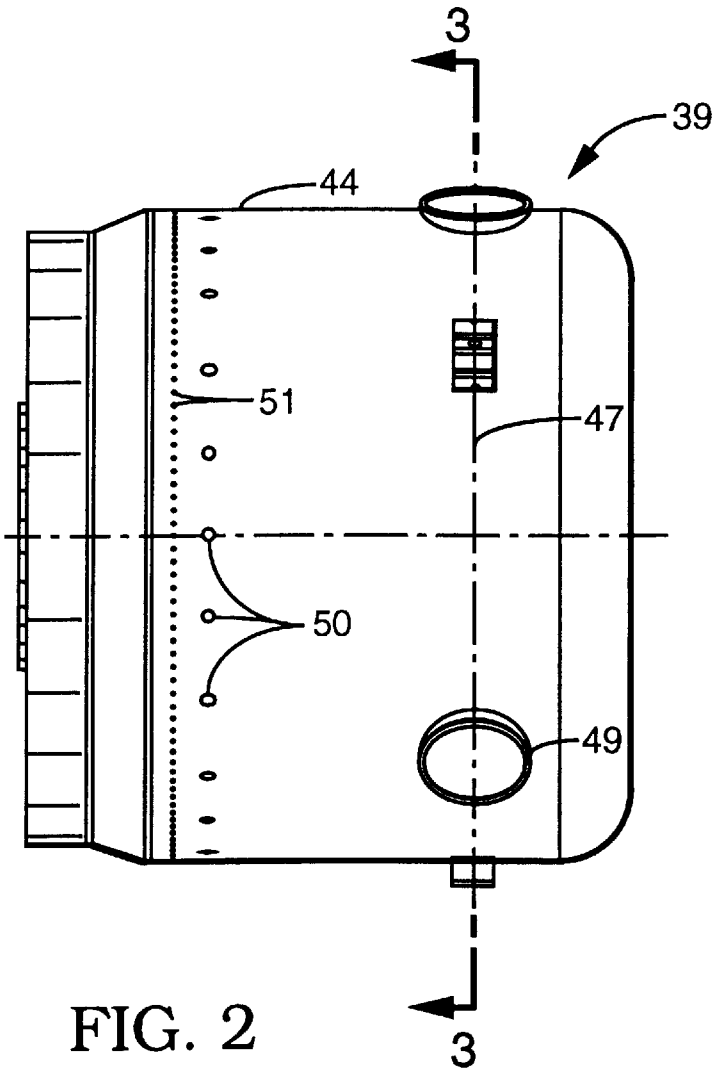
Figure 5:
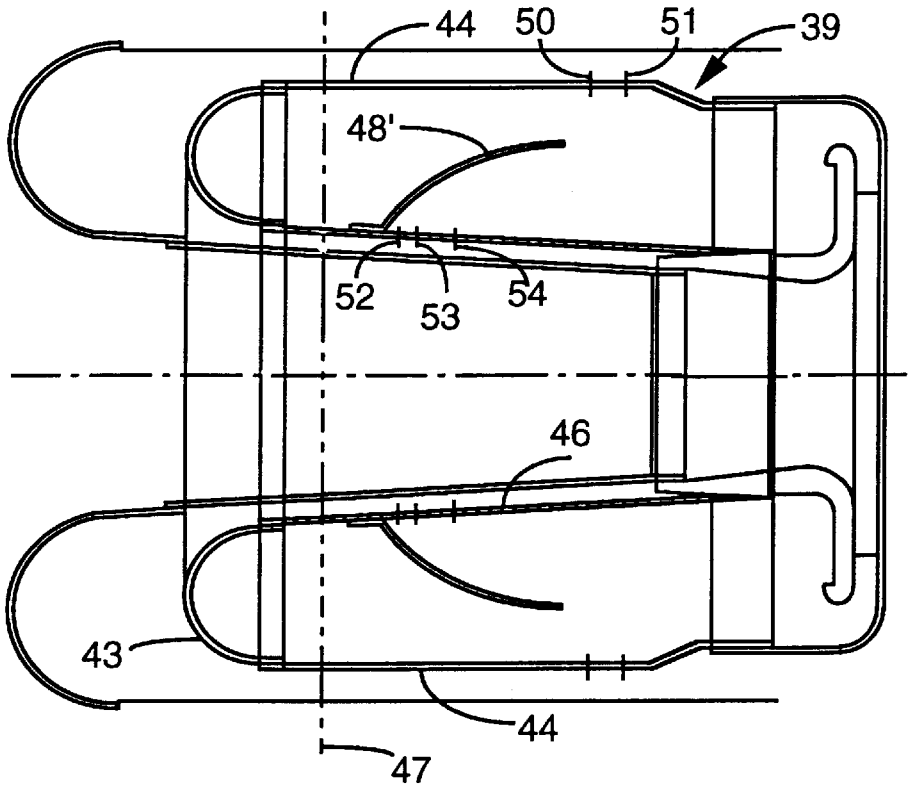
Figure 4:
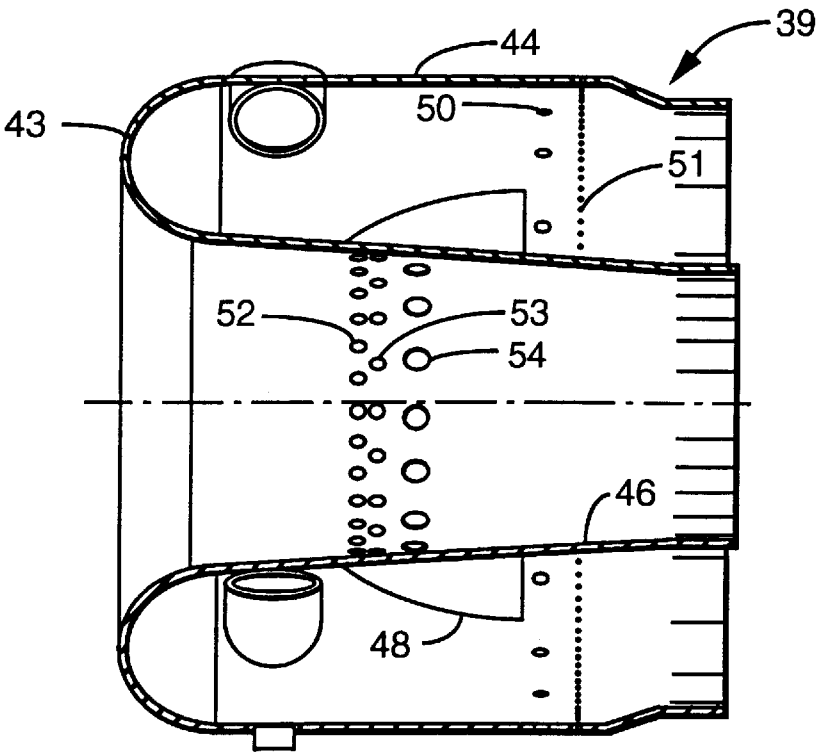
Figure 6:
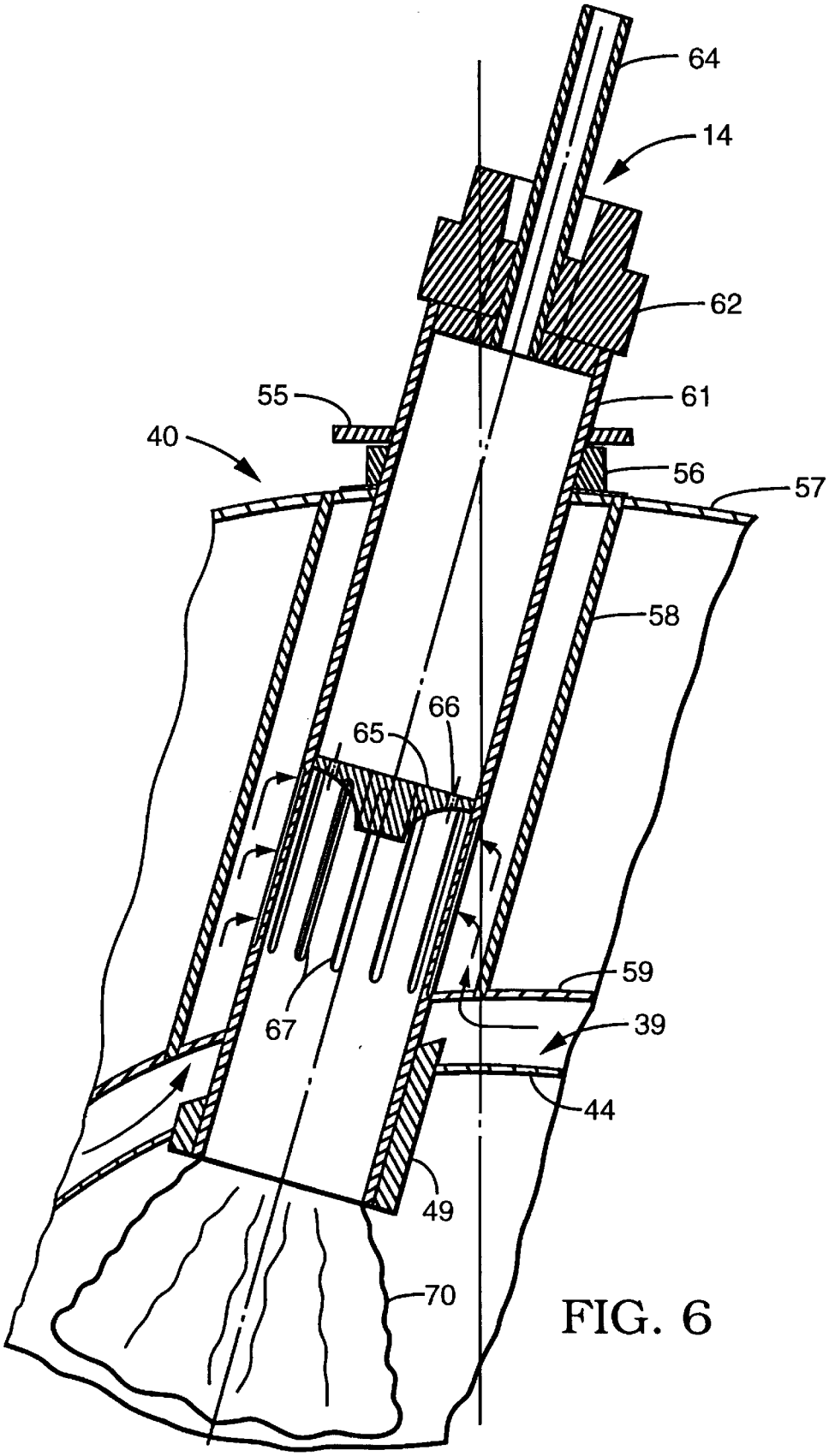
Figure 7:
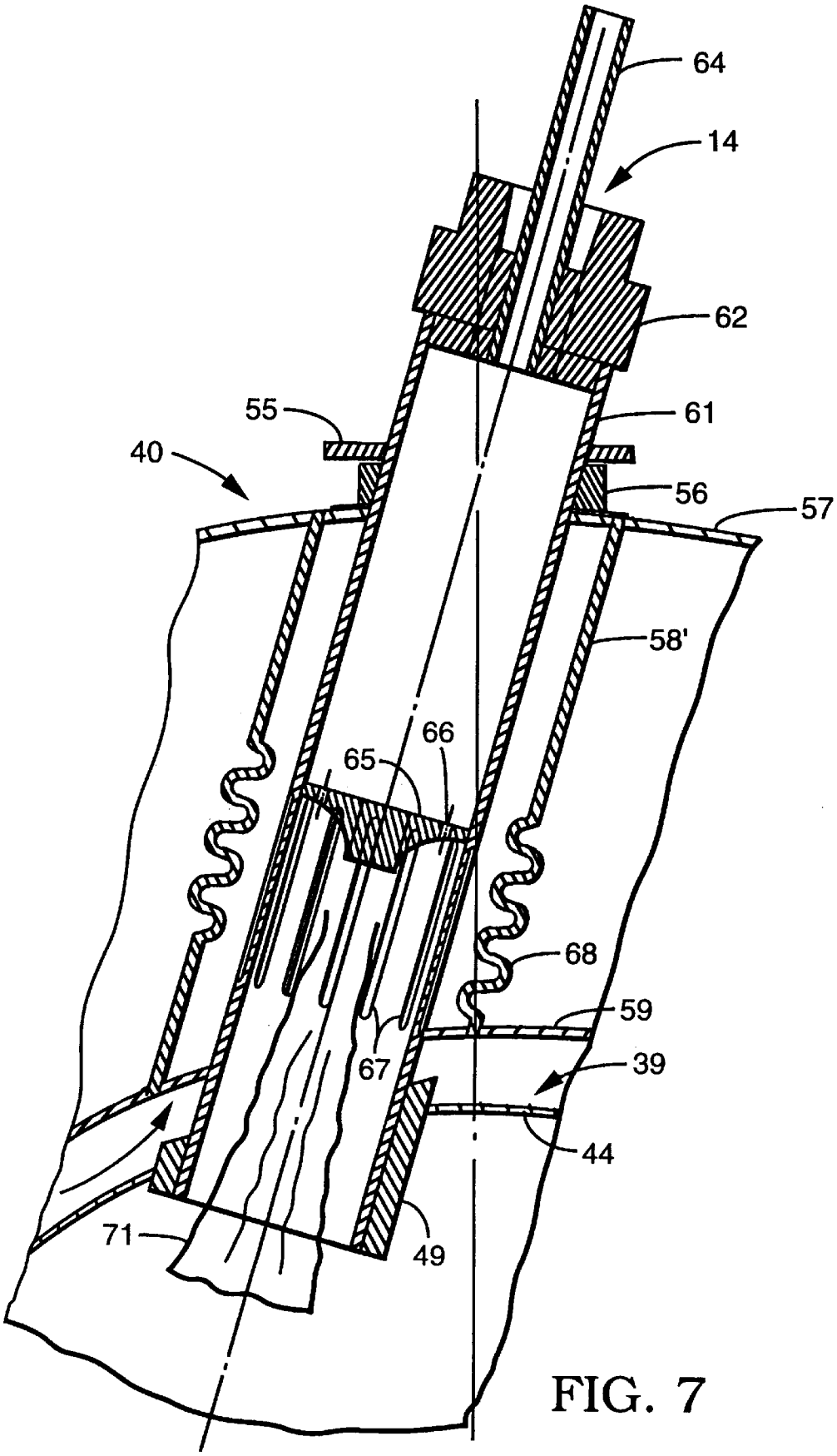
Figure 8:
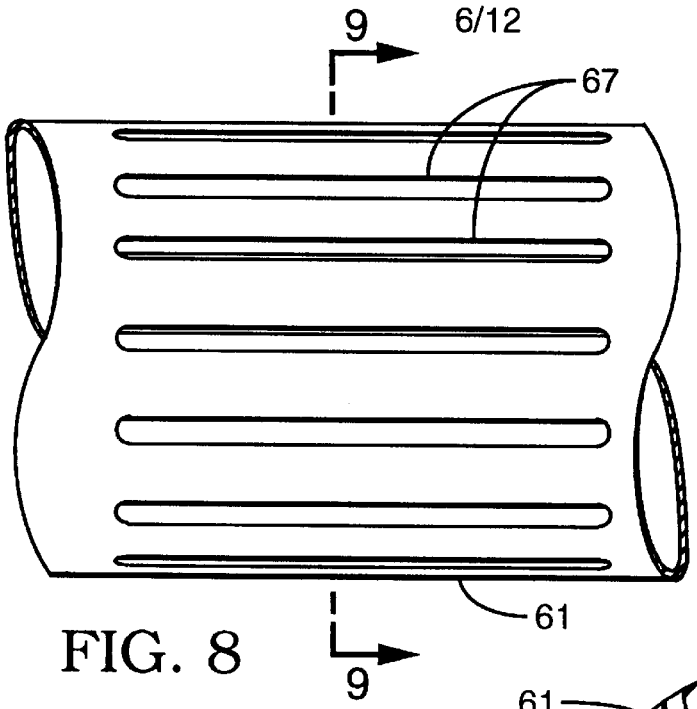
Figure 9:
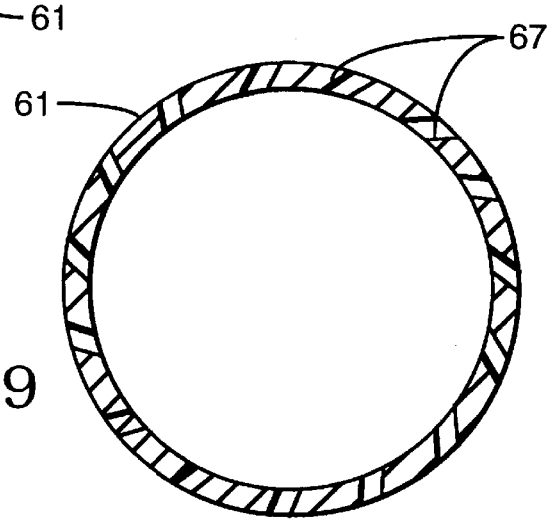
Figure 10:
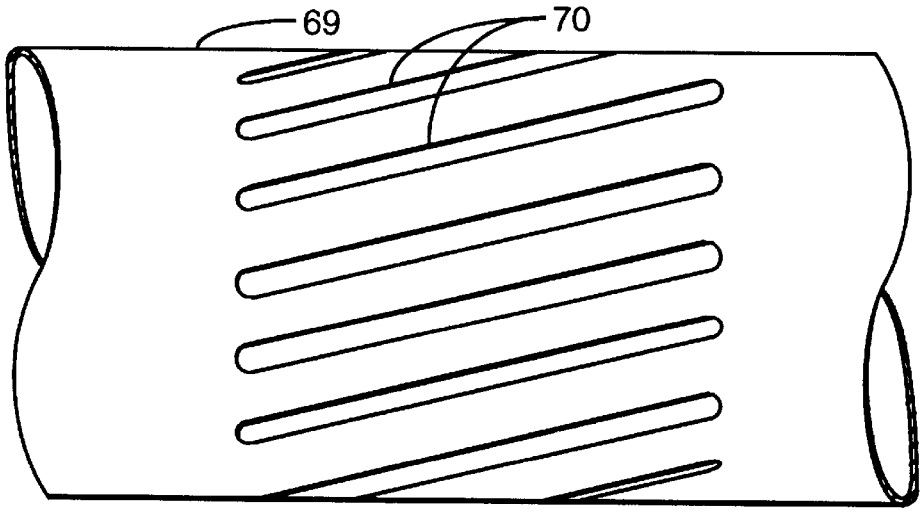
Figure 11:
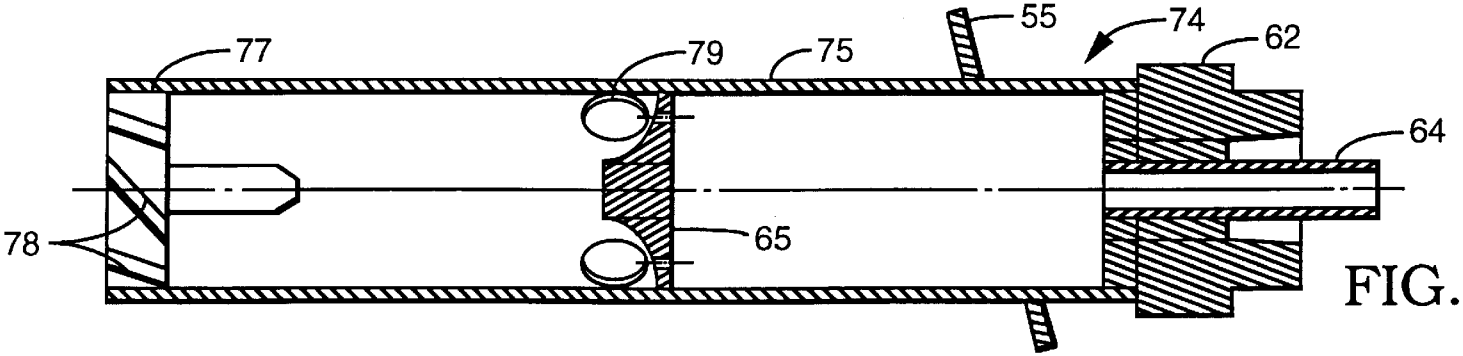
Figure 12:
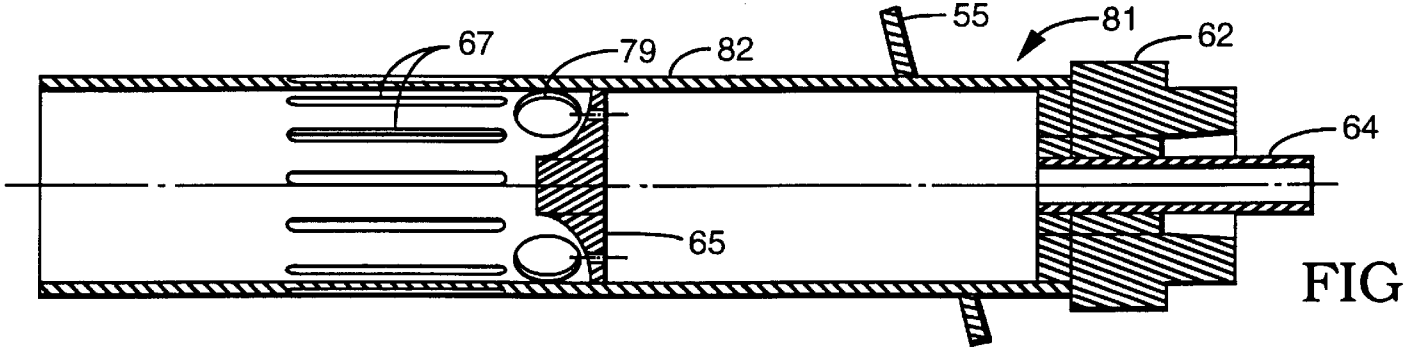
Figure 13:
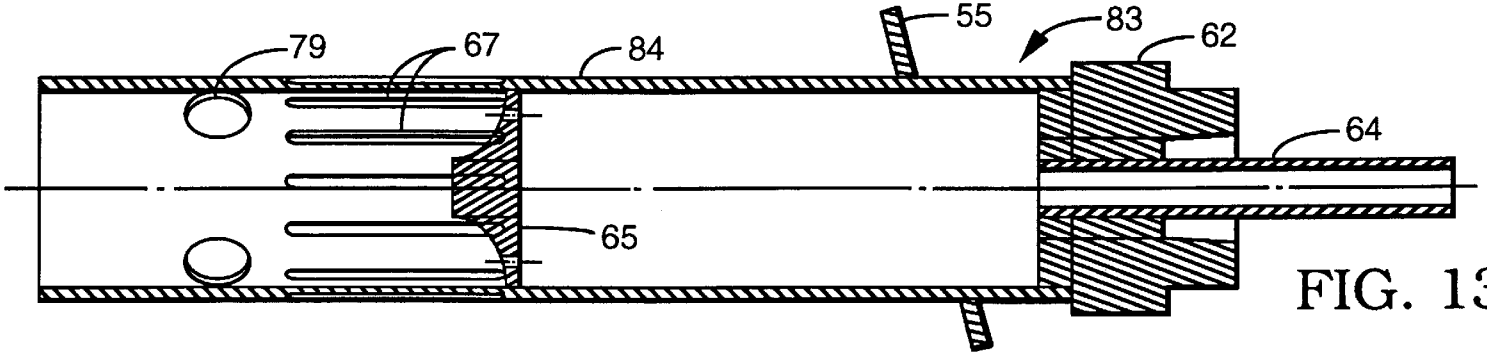
Figure 14:
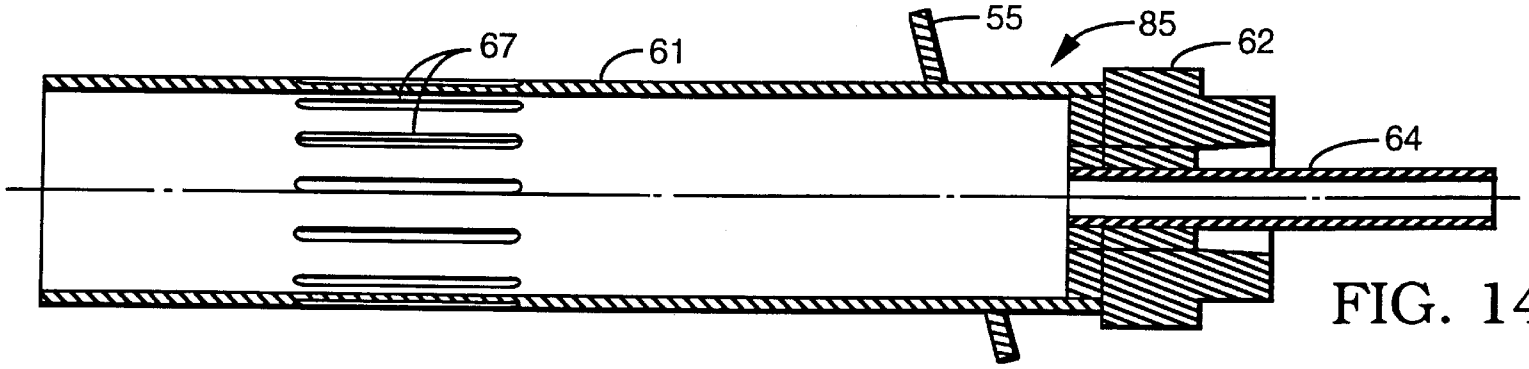
Figure 15:
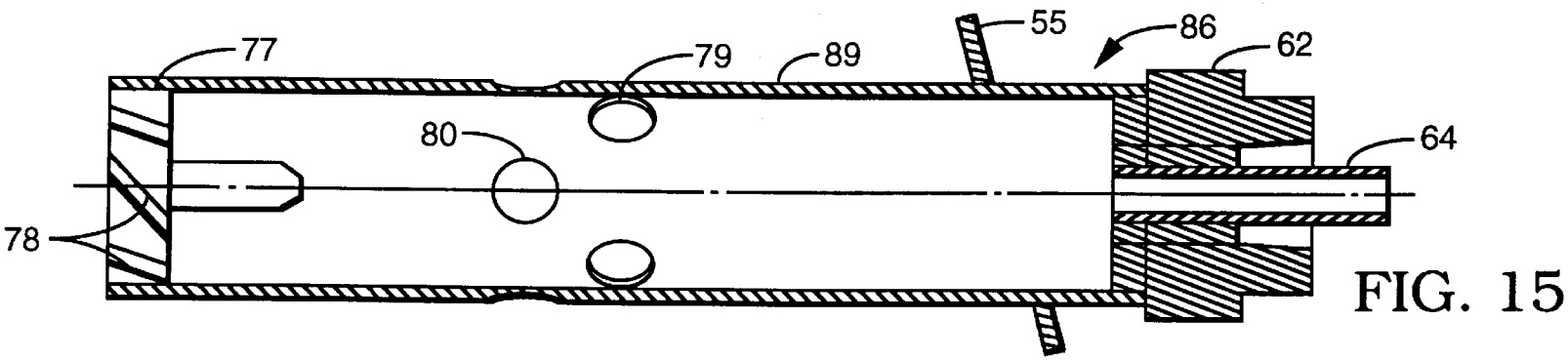
Figure 16:
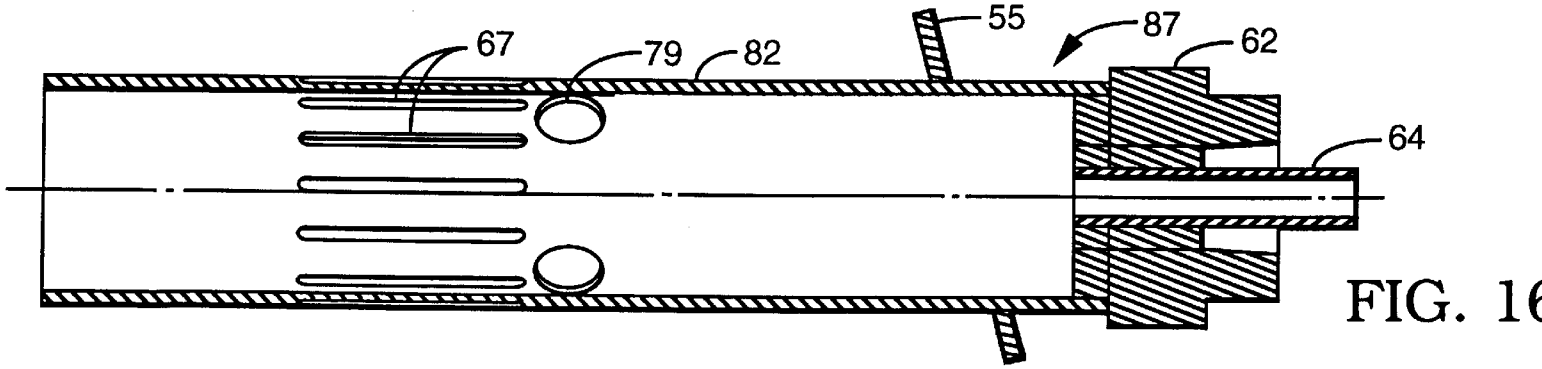
Figures 17, 18, 19:
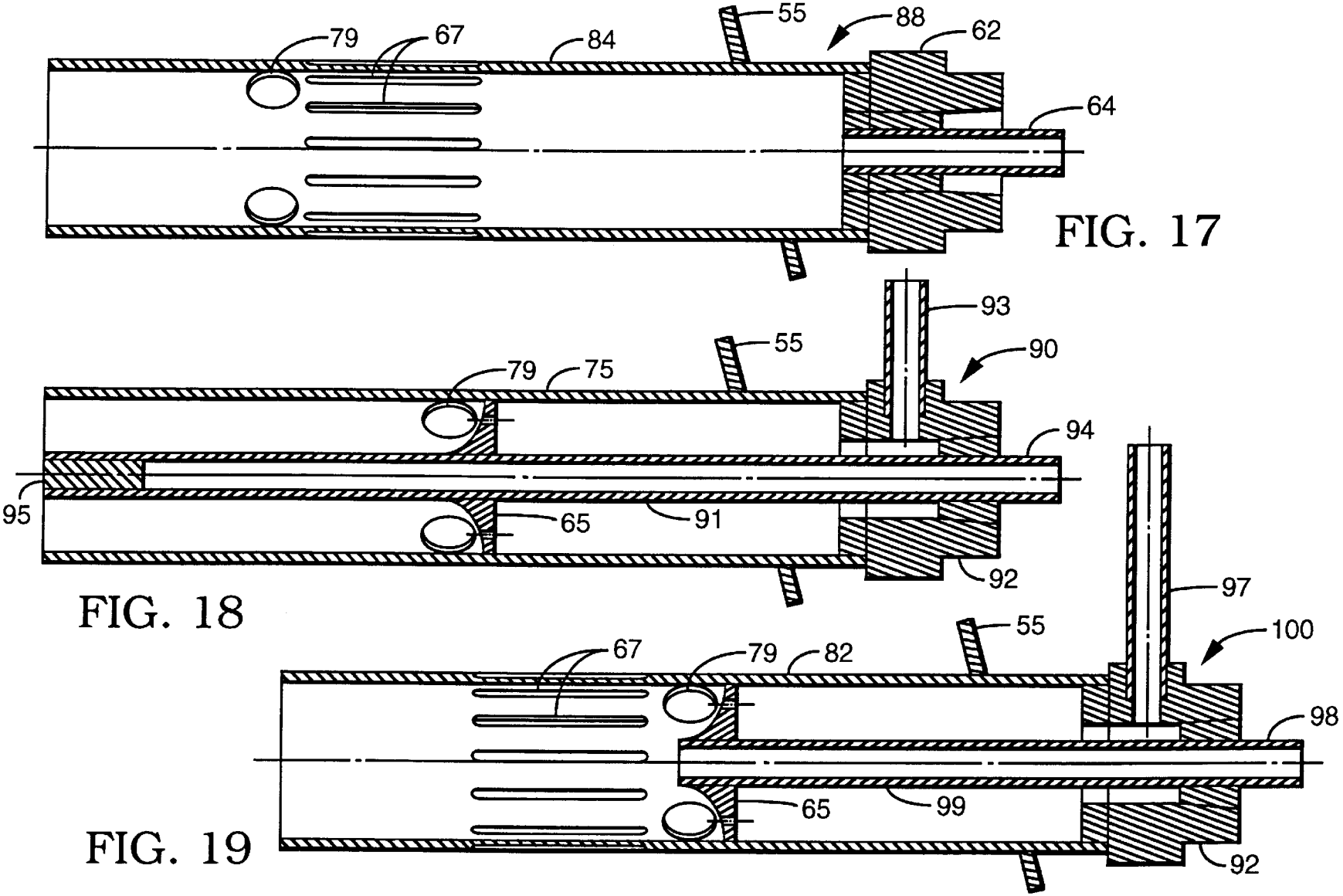
Figure 20:
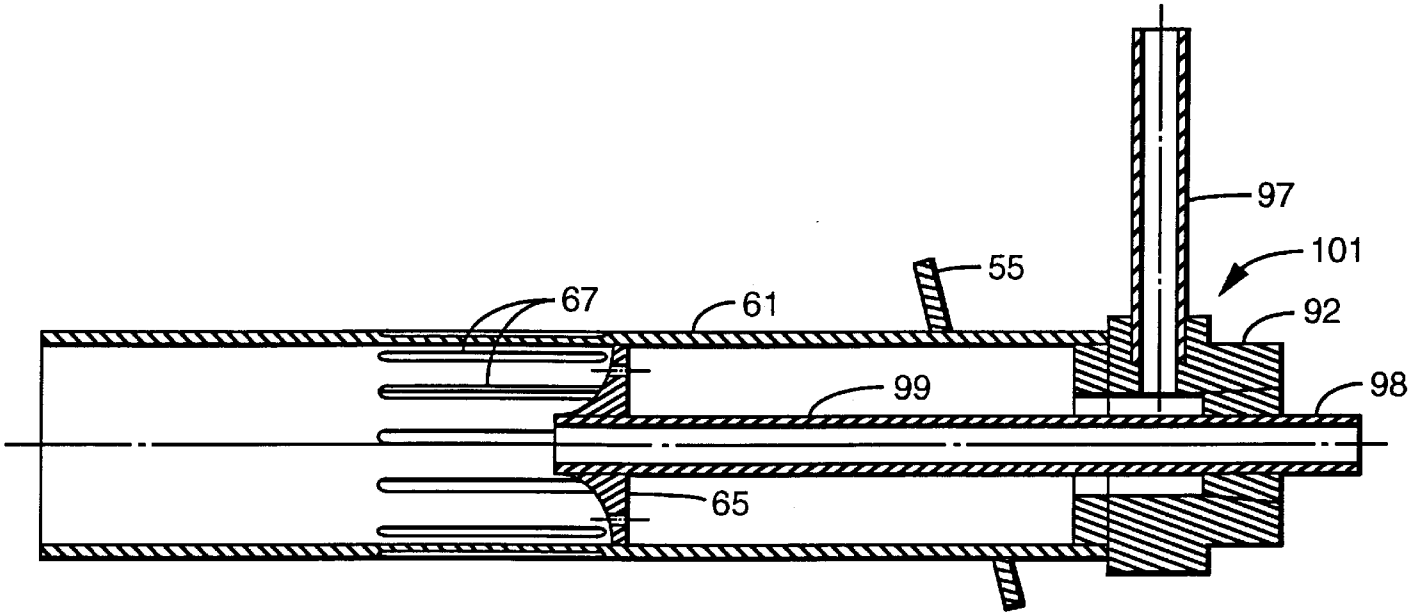
Figure 21:
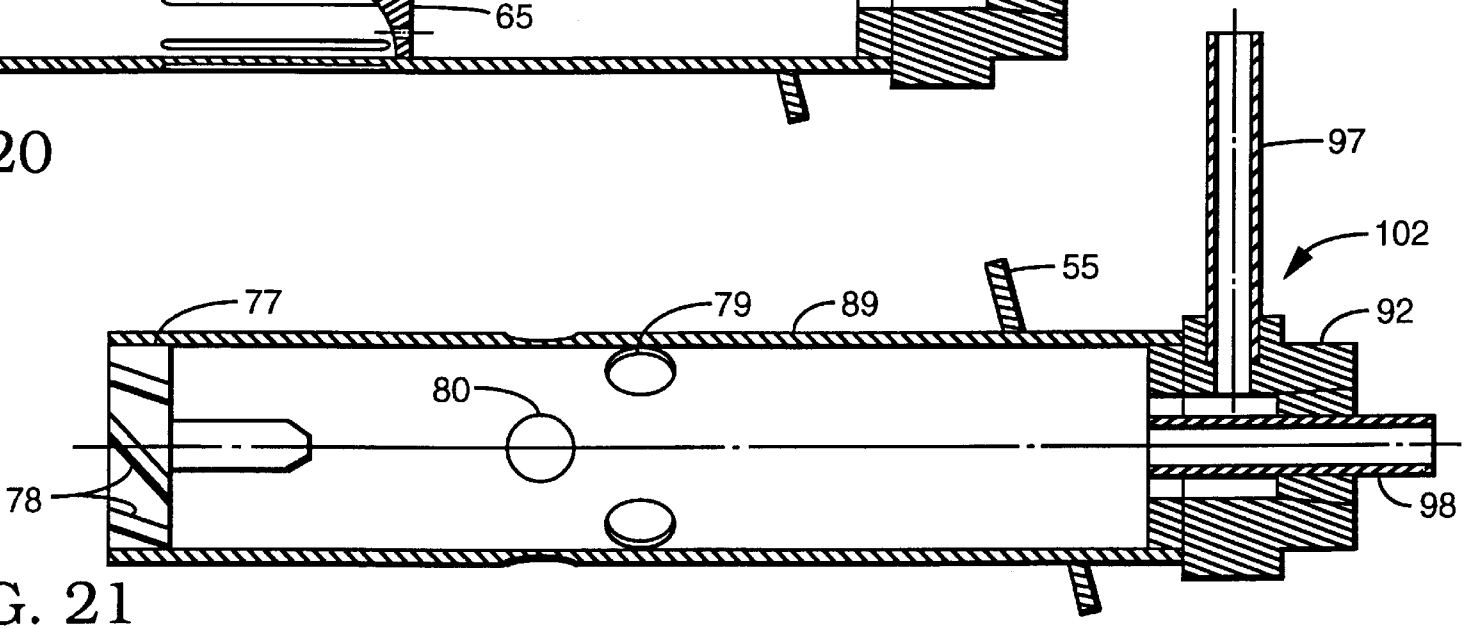
Figure 22:
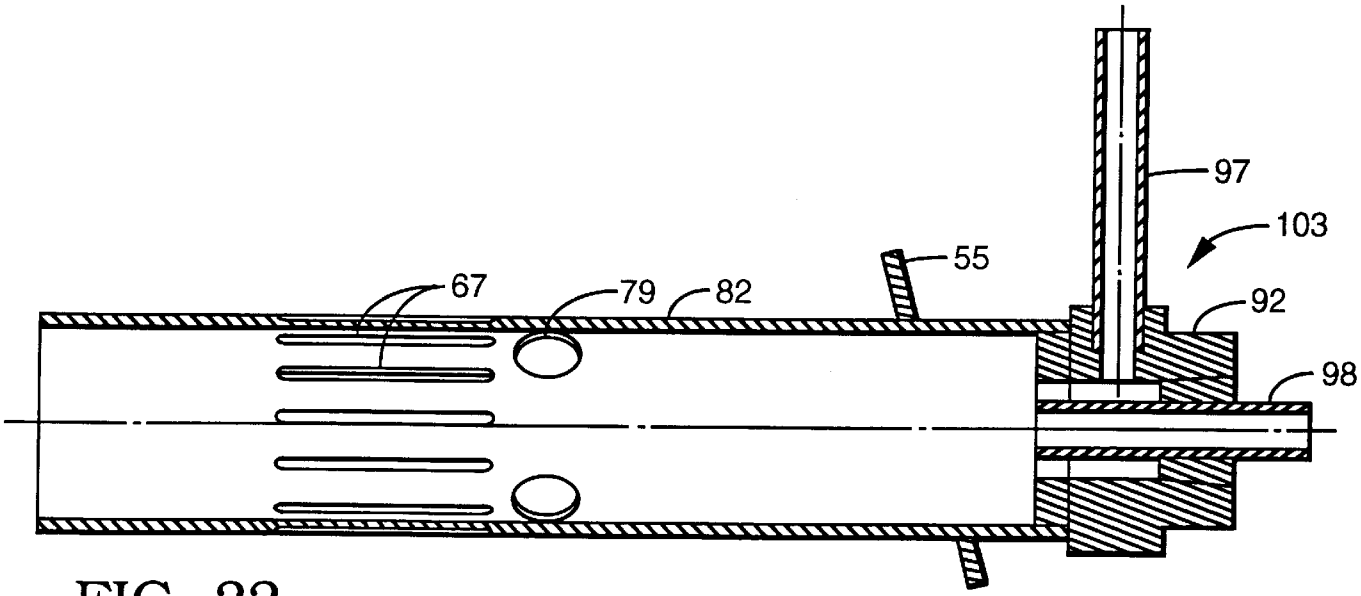
Figure 23:
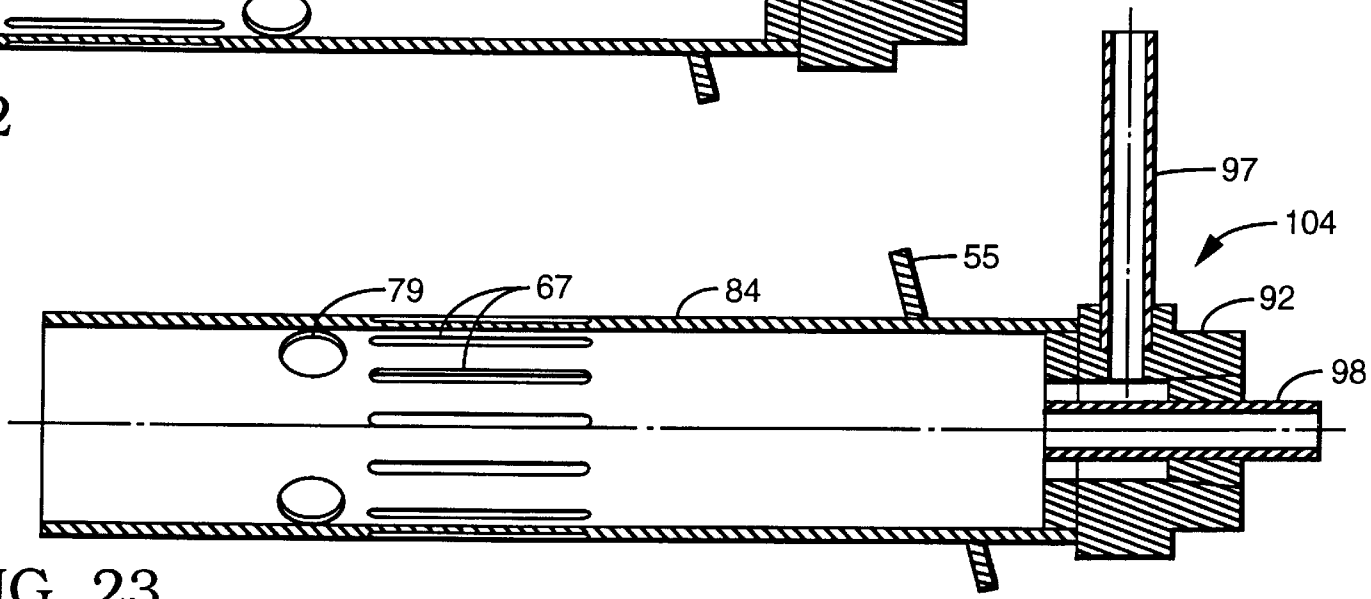

Having thus described the present invention in general terms, reference will now be made to the accompanying drawings in which:

FIG. 1 is a perspective view, partially cut away, of a turbogenerator utilizing the low emissions combustion system of the present invention;

FIG. 2 is a plan view of a combustor housing for the low emissions combustion system of the present invention;

FIG. 3 is a sectional view of the combustor housing of FIG. 2 taken along line 3—3 of FIG. 2;

FIG. 4 is a sectional view of the combustor housing of FIG. 3 taken along line 4—4 of FIG. 3;

FIG. 5 is an enlarged sectional view, partially schematic, of an alternate combustor housing for the low emissions combustion system of the present invention;

FIG. 6 is an enlarged sectional view of a fuel injector at full power for the low emissions combustion system of the present invention illustrating the passage of the fuel injector through the recuperator housing of the gas turbine engine and into the combustor housing;

FIG. 7 is an enlarged sectional view of a fuel injector at low power for the low emissions combustion system of the present invention illustrating the passage of the fuel injector through the recuperator housing of the gas turbine engine and into the combustor housing;

FIG. 8 is an enlarged portion of the fuel injector tube having elongated slits;

FIG. 9 is a section view of the fuel injector tube of FIG. 8 taken along line 9—9 of FIG. 8;

FIG. 10 is an enlarged portion of the alternate fuel injector tube having elongated slits;

FIG. 11 is a sectional view of an alternate fuel injector for the low emissions combustion system of the present invention;

FIG. 12 is a sectional view of another alternate fuel injector for the low emissions combustion system of the present invention;

FIG. 13 is a sectional view of yet another alternate fuel injector for the low emissions combustion system of the present invention;

FIG. 14 is a sectional view of still another alternate fuel injector for the low emissions combustion system of the present invention;

FIG. 15 is a sectional view of a further alternate fuel injector for the low emissions combustion system of the present invention;

FIG. 16 is a sectional view of a still further alternate fuel injector for the low emissions combustion system of the present invention;

FIG. 17 is a sectional view of yet a still further alternate fuel injector for the low emissions combustion system of the present invention;

FIG. 18 is a sectional view of another still further alternate fuel injector for the low emissions combustion system of the present invention;

FIG. 19 is a sectional view of a dual fuel injector for the low emissions combustion system of the present invention;

FIG. 20 is a sectional view of an alternate dual fuel injector for the low emissions combustion system of the present invention;

FIG. 21 is a sectional view of another alternate dual fuel injector for the low emissions combustion system of the present invention;

FIG. 22 is a sectional view of yet another alternate dual fuel injector for the low emissions combustion system of the present invention;

FIG. 23 is a sectional view of still another alternate dual fuel injector for the low emissions combustion system of the present invention;

FIG. 24 is a sectional view of a further alternate dual fuel injector for the low emissions combustion system of the present invention;

FIG. 25 is an end view of the swirler of the fuel injectors of FIGS. 11, 15, and 21;

FIG. 26 is a side view of the swirler of FIG. 25;

FIG. 27 is a sectional view of the swirler of FIG. 26 taken along line 27—27 of FIG. 26; and FIG. 28 is an enlarged perspective view of the swirler of FIGS. 25–27.

DETAILED DESCRIPTION OF THE PREFERRED EMBODIMENTS

The turbogenerator 12 utilizing the low emissions combustion system of the present invention is illustrated in FIG. 1. The turbogenerator 12 generally comprises a permanent magnet generator 20, a power head 21, a combustor 22 and a recuperator (or heat exchanger) 23.

The permanent magnet generator 20 includes a permanent magnet rotor or sleeve 26, having a permanent magnet disposed therein, rotatably supported within a permanent magnet stator 27 by a pair of spaced journal bearings. Radial permanent magnet stator cooling fins 28 are enclosed in an outer cylindrical sleeve 29 to form an annular air flow passage which cools the permanent magnet stator 27 and thereby preheats the air passing through on its way to the power head 21.

The power head 21 of the turbogenerator 12 includes compressor 30, turbine 31, and bearing rotor 32 through which the tie rod 33 to the permanent magnet rotor 26 passes. The compressor 30, having compressor impeller or wheel 34 which receives preheated air from the annular air flow passage in cylindrical sleeve 29 around the permanent magnet stator 27, is driven by the turbine 31 having turbine wheel 35 which receives heated exhaust gases from the combustor 22 supplied with preheated air from recuperator 23. The compressor wheel 34 and turbine wheel 35 are supported on a bearing shaft or rotor 32 having a radially extending bearing rotor thrust disk 36. The bearing rotor 32 is rotatably supported by a single journal bearing within the center bearing housing 37 while the bearing rotor thrust disk 36 at the compressor end of the bearing rotor 32 is rotatably supported by a bilateral thrust bearing.

Intake air is drawn through the permanent magnet generator 20 by the compressor 30 which increases the pressure of the air and forces it into the recuperator 23. The recuperator 23 includes an annular housing 40 having a heat transfer section 41, an exhaust gas dome 42 and a combustor dome 43. Exhaust heat from the turbine 31 is used to preheat the air before it enters the combustor 22 where the preheated air is mixed with fuel and burned. The combustion gases are then expanded in the turbine 31 which drives the compressor 30 and the permanent magnet rotor 26 of the permanent magnet generator 20 which is mounted on the same shaft as the turbine 31. The expanded turbine exhaust gases are then passed through the recuperator 23 before being discharged from the turbogenerator 12.

The combustor housing 39 of the combustor 22 is illustrated in FIGS. 2–4, and generally comprises a cylindrical outer liner 44 and a tapered inner liner 46 which, together with the combustor dome 43, form a generally expanding annular combustion housing or chamber 39 from the combustor dome 43 to the turbine 31. A plurality of fuel injector guides 49 (shown as three) position the fuel injectors 14 to tangentially introduce a fuel/air mixture at the combustor dome 43 end of the annular combustion housing 39 along the fuel injector axis or centerline 47. This same centerline 47 includes an ignitor cap to position an ignitor (not shown) within the combustor housing 39. The combustion dome 43 is rounded out to permit the swirl pattern from the fuel injectors 14 to fully develop and also to reduce structural stress loads in the combustor.

A flow control baffle 48 extends from the tapered inner liner 46 into the annular combustion housing 39. The baffle 48, which would be generally skirt-shaped, would extend between one-third and one-half of the distance between the tapered inner liner 46 and the cylindrical outer liner 44. Three rows each of a plurality of spaced offset air dilution holes 52, 53, and 54 in the tapered inner liner 46 underneath the flow control baffle 48 introduce dilution air into the annular combustion housing 39. The first two (2) rows of air dilution holes 52 and 53 (closest to the fuel injector centerline 47) may be the same size with both, however, smaller than the third row of air dilution holes 54.

In addition, two (2) rows each of a plurality of spaced air dilution holes 50 and 51 in the cylindrical outer liner 44, introduce more dilution air downstream from the flow control baffle 48. The plurality of holes 50 closest to the flow control baffle 48 may be larger and less numerous than the second row of holes 51.

An alternate combustor housing 39' is illustrated in FIG. 5 and is substantially similar to the combustor housing 39 of FIGS. 2–4 except that the flow control baffle 48' extends between one-half to two-thirds of the distance between the tapered inner liner 46 and cylindrical outer liner 44.

The low emissions combustor system of the present invention can operate on gaseous fuels, such as natural gas, propane, etc., liquid fuels such as gasoline, diesel oil, etc., or can be designed to accommodate either gaseous or liquid fuels. The fuel injectors of FIGS. 6–18 are designed for operation on a single fuel. The fuel injectors of FIGS. 19–24 have individual inlets for both a gaseous fuel and for a liquid fuel and can operate on whichever fuel would be available.

Fuel can be provided individually to each fuel injector 14, or, as shown in FIG. 1, a fuel manifold 15 can be used to supply fuel to all three (3) fuel injectors 14. The fuel manifold 15 includes a fuel inlet 16 to receive fuel from a fuel source (not shown). Flow control valves 17 are provided in each of the fuel lines from the manifold 15 to the fuel injectors 14. In order to sustain low power operation, maintain fuel economy and low emissions, the flow control valves 17 can be individually controlled to an on/off position (to separately use any combination of fuel injectors individually) or they can be modulated together. The flow control valves 17 can be opened by fuel pressure or their operation can be controlled or augmented with a solenoid.

FIG. 6 illustrates the fuel injector 14 extending through the recuperator housing 40 and into the combustor housing 39 through an fuel injector guide 49. The fuel injector flange 55 is attached to a boss 56 on the outer recuperator wall 57 and extends through an angled tube 58 between the outer recuperator wall 57 and the inner recuperator wall 59. The fuel injector 14 extends through the fuel injector guide 49 in the cylindrical outer liner 44 of the combustor housing 39 into the interior of the annular combustion housing 39.

The fuel injectors 14 generally comprise an injector tube 61 having an inlet end and a discharge end. The inlet end of the injector tube 61 includes a coupler 62 having a fuel inlet tube 64 which provides fuel to the injector tube 61. The fuel is distributed within the injector tube 61 to be a centering ring 65 having a plurality of spaced openings 66 to permit the passage of fuel. These openings 66 serve to provide a good distribution of the fuel injector tube 61.

The space between the angled tube 58 and the outer injector tube 61 is open to the space between the inner recuperator wall 59 and the cylindrical outer liner 44 of the combustor housing 39. Heated compressed air from the recuperator 23 is supplied to the space between the inner recuperator wall 59 and the cylindrical outer liner 44 of the combustor housing 39 and is thus available to the interior of the angled tube 58.

A plurality of elongated slits 67 in the injector tube 61 downstream of the centering ring 65 provide compressed air from the angled tube 58 to the fuel in the injector tube 61 downstream of the centering ring 65. These elongated slits receive the compressed air from the angled tube 58 which receives compressed air from the space between the inner recuperator wall 59 and the cylindrical outer liner 44 of the combustor housing 39. The downstream face of the centering ring 65 can be sloped to help direct the compressed air entering the injector tube 61 in a downstream direction.

The elongated slits 67 are shown in more detail in FIGS. 8 and 9. While the slits 67 generally extend parallel to the axis or centerline of the injector tube 61, they are radially angled, that is the sidewalls of the slits 67 are not radial but rather are angled. This angle will direct the compressed air to enter the injector tube 61 in a generally tangential direction to better mix with and swirl the fuel exiting from the fuel distribution centering ring 65 in the injector tube 61. Alternately, the injector tube 69 may include elongated slits 70 which are angled from the axis or centerline of the injector tube 69 as shown in FIG. 10. This will also serve to mix and swirl the fuel exiting from the fuel distribution centering ring 65 in the injector tube 61.

At full power, the flame 70 from the fuel injector 14 will be inside the combustor housing 39 as illustrated in FIG. 6. The highly premixed fuel and air mixture leads to quite low NOx levels. As however, the power is cut back and fuel flow is decreased, the flame 71 will flash-back into the injector tube 61 and stabilize in the injector tube 61 as illustrated in FIG. 7. The injector tube 61, fuel distribution centering ring 65, and the swirl slits 67 together serve to stabilize the flame within the injector tube 61.

While the flame 71 stabilized within the injector tube 61 does result in somewhat higher NOx levels when compared to the flame 70 outside the injector tube 61, this is more than made up by the increased turn-down ratio which is achieved. Whereas a normal turn-down ratio for the low emissions combustion system of the present invention would be on the order of four (4), stabilizing the flame 71 within the injector tube 61 can achieve a turn-down ratio of over twenty (20). With a turn-down ratio of this magnitude, control of the combustion system can be greatly simplified and staging of the plurality of fuel injectors 14 can be eliminated. Not only is the cost of the combustion system significantly reduced, the life of the combustion system and its stability is significantly increased.

An alternate angled tube 58' is illustrated in FIG. 7. This angled tube 58', which extends between the outer recuperator wall 57 and the inner recuperator wall 59 includes a bellows section 68 which can accommodate differential thermal expansion between the angled tube 58' and the recuperator housing 40 through which it extends.

In the fuel injector 74 of FIG. 11, the injector tube 75 includes a row of holes 79 downstream of the fuel distribution centering ring 65 and the discharge end of the fuel injector tube 75 includes a face swirler 77 to promote the mixing of the fuel and air before discharge of the fuel/air mixture into the combustor housing 39 and flame stabilization at the injector exit and within the combustor housing 39. This face swirler 77, which has a plurality of vanes 78, is shown in more detail in FIGS. 25–27.

As illustrated in FIG. 12, the fuel injector 81 includes fuel injector tube 82 having a plurality of holes 79 and then a plurality of elongated slits 67 disposed downstream of the fuel distribution centering ring 65. The position of the holes 79 and slits 67 are reversed in the fuel injector tube 84 of the fuel injector 83 of FIG. 13.

The fuel injectors 85, 86, 87, and 88 of FIGS. 14–17 respectively, generally correspond to the fuel injectors 14, 74, 81, and 83 of FIGS. 6, 11, 12, and 13, respectively, except that the fuel injectors 85, 86, 87, and 88 do not include the fuel distribution centering ring 65 of fuel injectors 14, 17, 81, and 83. The only other difference is that the fuel injector tube 89 of fuel injector 86 includes two (2) rows of a plurality of offset holes 79 and 80 rather than a single row of holes 79 as in fuel injector tube 75 of fuel injector 74.

A somewhat different fuel injector 90 is illustrated in FIG. 18. Fuel injector 90 generally comprises an inner injector tube 91 concentrically disposed within outer injector tube 75. The inlet end of the outer injector tube 75 includes a coupler 92 having a main fuel inlet tube 93. The extension 94 of the inner injector tube 91 outside of the coupler 92 provides a secondary or pilot fuel inlet. The fuel inlet tube 93 provides fuel to the annular space between the inner injector tube 91 and outer injector tube 75, while the extension 94 of the inner injector tube 91 provides fuel to a pilot flame holder 95 at the discharge end of the inner injector tube 91. The inner injector tube 91 is maintained concentrically within the outer injector tube 75 by fuel distribution centering ring 65 disposed generally midway between the coupler 92 and the pilot flame holder 95.

As previously stated, the fuel injectors of FIGS. 6–18 are specifically designed to use gaseous fuel and certainly would be most advantageously used with a gaseous fuel. Under some circumstances, however, these same fuel injectors could use liquid fuel instead of gaseous fuel. As represented by FIGS. 19–24, these fuel injectors are, however, specifically designed to accommodate either gaseous and liquid fuel depending solely upon fuel availability.

The fuel injectors 101–105 of FIGS. 19–24, respectively, each include a fuel injector tube, 82 for FIGS. 19 and 22, 61 for FIGS. 20 and 24, 89 for FIG. 21, and 84 for FIG. 23.

Each of these fuel injector tubes extend from the coupler 92 which includes a perpendicular fuel inlet tube 97 for gaseous fuel and a concentric fuel inlet tube 98 for liquid fuel. Fuel injectors 100 and 101 include a concentric inner injector tube 99 extending from fuel distribution centering ring 65 to the concentric fuel inlet tube 98 of coupler 92. The fuel injector tube 82 of fuel injector 100 includes both offset holes 79 and elongated slits 67 while fuel injector tube 61 of fuel injector 101 only includes elongated slits 67.

The fuel injector tube 89 of fuel injector 102 includes two (2) rows each of a plurality of offset holes 79 and 80 and also a swirler 77 having vanes 78. A row of holes 79 and a row of elongated slits 67 are included in fuel injector tubes 82 and 84 of fuel injector 103 and 104, respectively, with the slits 67 downstream of the holes 79 in fuel injector tube 82 and vice versa in fuel injector tube 84. The fuel injector tube 61 of fuel injector 105 includes only a plurality of elongated slits 67.

The swirler 77 is illustrated in FIGS. 25–27. Six (6) vanes 78 are shown to impart the swirling motion to the fuel/air mixture passing through but the swirler may consist of more or less vanes. The swirler 107 of FIG. 28 is just a different view of the swirler illustrated in FIGS. 25–27.

The improved low emissions combustion system of the present invention employs a lean premixed combustion zone throughout. The present invention utilizes an annular combustor with tangential injection of a fuel/air mixture in the primary zone followed by the injection of dilution air in a secondary zone. The combustor is very large, at least an order of magnitude, when compared to the standard size associated with a given power level. The high mixing and low equivalence ratio will lead to a very low level of NOx formation in the primary zone.

The lean secondary zone is formed by flowing air through secondary holes beneath the flow control baffle and also further downstream from the flow control baffle. The flow control baffle prevents the establishment of a separate quench zone in the combustor. Swirling/impinging jets are used to form a high degree of turbulence and increase local mixing. Low levels of CO are obtained because of the low velocities and high residence times in the primary zone which is obtained by use of the oversize combustor with tangential injection. The large combustor produces higher velocities between the combustor and combustor casing which increases the amount of convection cooling to the combustor walls and thus eliminating the need for film cooling which often leads to the formation of CO and HC.

The use of the combustion system of the present invention achieves low emissions while still employing a relatively simple design and construction. There are any number of possible combinations of elements of the present invention. Certain of the fuel injectors are designed to operate on gaseous fuel, others of the fuel injectors are designed to operate on liquid fuel, while some of the fuel injectors are able to function on whatever fuel is available, either gaseous or liquid.

The vaned swirlers are particularly advantageous in keeping emission levels very low over the entire operating range of the combustion system. With the pilot flame instead of a swirler, however, at low power operation the NOx may be somewhat higher. On the other hand, the pilot flame will have a significantly better turn-down as will stabilizing the flame within the injector tube during low power operation. Staging or sequencing of the fuel injectors will also provide a wide range of operating conditions which greatly increases the pattern factor during off loading.

The low emissions combustion system of the present invention can achieve less than 9 ppm V of NMOG, CO, and NOx at 15% $O_2$ for natural gas at design point. A high level of mixing between the fuel and air is obtained in the fuel injector and also in the way that the air is injected into the combustor. Thus, low emissions can be obtained in a relatively simple construction, avoiding many of the complexities typically required to obtain low emissions in a gas turbine combustor.

While specific embodiments of the invention have been illustrated and described, it is to be understood that these are provided by way of example only and that the invention is not to be construed as being limited thereto but only by the proper scope of the following claims.

What we claim is:

1. A low emissions combustion system for a gas turbine engine, comprising:

an annular combustor having an outer liner, an inner liner, a closed upstream end, and an open discharge end;

a plurality of tangential fuel injectors spaced around and mounted to the periphery of said closed end of said combustor;

a curved, generally skirt-shaped, flow control baffle extending from said inner liner downstream into the annular combustor between said inner liner and said outer liner, said curved, generally skirt-shaped, flow control baffle projecting from generally one-third to two-thirds of the distance between said inner liner and said outer liner;

a plurality of spaced air dilution openings in said inner liner beneath said curved, generally skirt-shaped, flow control baffle, said curved, generally skirt-shaped, flow control baffle directing the air from said plurality of spaced air dilution openings in a downstream direction; and a plurality of spaced air dilution openings in said outer liner of said annular combustor to inject additional dilution air into said annular combustor.

2. The low emissions combustion system of claim 1 wherein said plurality of spaced air dilution openings in said outer liner of said annular combustor are generally downstream of said curved, generally skirt-shaped, flow control baffle.

3. The low emissions combustion system of claim 1 wherein said annular combustor is generally expanding in annular area until the open discharge end thereof.

4. The low emissions combustion system of claim 3 wherein said outer liner is generally of a constant diameter until the discharge end of said annular combustor and said inner liner has a decreasing diameter from the closed upstream end of said annular combustor to the discharge end of said annular combustor.

5. The low emissions combustion system of claim 1 wherein the closed end of said annular combustor is generally dome-shaped.

6. The low emissions combustion system of claim 1 wherein said outer liner of said annular combustor includes a plurality of slanted fuel injector guides extending through said outer liner to tangentially position said plurality of fuel injectors.

7. The low emissions combustion system of claim 1 wherein said curved, generally skirt shaped, flow control baffle projects from generally one-third to one-half of the distance between said inner liner and said outer liner.

8. The low emissions combustion system of claim 1 wherein said curved, generally skirt shaped, flow control baffle projects from generally one-half to two-thirds of the distance between said inner liner and said outer liner.

9. The low emissions combustion system of claim 1 wherein said plurality of spaced air dilution openings in said inner liner beneath said curved, generally skirt shaped, flow control baffle include a plurality of rows of offset holes.

10. The low emissions combustion system of claim 9 wherein said plurality of rows of offset holes in said inner liner is three.

11. The low emissions combustion system of claim 10 wherein the two upstream rows of holes in said inner liner have the same size and are offset from one another and the third downstream row of holes in said inner liner are larger than the holes in said two upstream rows of holes in said inner liner.

12. The low emissions combustion system of claim 1 wherein said plurality of spaced air dilution openings in said outer liner include a plurality of rows of offset holes.

13. The low emissions combustion system of claim 12 wherein said plurality of rows of offset holes in said outer liner is two.

14. The low emissions combustion system of claim 13 wherein the upstream row of offset holes in said outer liner are larger than the holes in the downstream row of offset holes in said outer liner.

15. The low emissions combustion system of claim 1 wherein said plurality of spaced air dilution openings in said inner liner beneath said curved, generally skirt shaped, flow control baffle include a plurality of rows of offset holes and said plurality of spaced air dilution openings in said outer liner include a plurality of rows of offset holes.

16. The low emissions combustion system of claim 15 wherein said plurality of rows of offset holes in said inner liner is three and said plurality of rows of offset holes in said outer liner is two.

17. The low emissions combustion system of claim 16 wherein the two upstream rows of holes in said inner liner have the same size and are offset from one another and the third downstream row of holes in said inner liner are larger than the holes in said two upstream rows of holes, and the upstream row of offset holes in said outer liner are larger than the holes in the downstream row of offset holes in said outer liner.

18. A low emissions combustion system for a gas turbine engine having a compressor, a turbine for driving said compressor, and an annular recuperator, including a housing, for receiving exhaust gases from said turbine to heat the combustion air, said low emissions combustion system comprising:

an annular combustor for producing hot combustion gases to drive said turbine, said annular combustor concentrically disposed within said annular recuperator housing with an annular space therebetween supplied with heated compressed air from said recuperator, said annular combustor having an outer liner, an inner liner, a generally dome-shaped closed upstream end, and an open discharge end, said outer liner including a plurality of slanted fuel injector guides tangentially extending therethrough;

said recuperator housing including a plurality of spaced angled tubes extending therethrough and open to the annular space between said recuperator housing and said combustor;

a plurality of tangential fuel injectors extending through said recuperator housing in said plurality of angled tubes and through said plurality of slanted fuel injector guides in said outer liner of said annular combustor to the closed end of said annular combustor, with one fuel injector extending through one angled tube and one slanted guide;

a curved, generally skirt-shaped, flow control baffle extending from said inner liner downstream into the annular combustor between said inner liner and said outer liner, said curved, generally skirt-shaped, flow control baffle projecting from generally one-third to two-thirds of the distance between said inner liner and said outer liner;

a plurality of spaced air dilution openings in said inner liner beneath said curved, generally skirt-shaped, flow control baffle, said curved, generally skirt-shaped, flow control baffle directing the air from said plurality of spaced air dilution openings in a downstream direction;

a plurality of spaced air dilution openings in said outer liner of said annular combustor to inject additional dilution air into said annular combustor.

19. The low emissions combustion system of claim 18 wherein said plurality of spaced air dilution openings in said outer liner of said annular combustor are downstream of said curved, generally skirt-shaped, flow control baffle.

20. The low emissions combustion system of claim 18 wherein each of said plurality of tangential fuel injectors comprises:

an elongated injector tube having an outer end and a discharge end;

a fuel inlet tube; and a coupler joining the outer end of said elongated injector tube with said fuel inlet tube, said elongated injector tube having a plurality of openings therein intermediate said coupler and said discharge end thereof for the entry of compressed air from said angled tube into the interior of said elongated injector tube to mix with fuel from said fuel inlet tube in said elongated injector tube.

21. The low emissions combustion system of claim 20 wherein said plurality of openings in said elongated injector tube includes elongated slits.

22. The low emissions combustion system of claim 21 wherein said elongated slits have sidewalls which are radially angled for tangential entry of the compressed air into said injector tube.

23. The low emissions combustion system of claim 21 wherein said elongated slits are oriented parallel to the axis of said elongated injector tube.

24. The low emissions combustion system of claim 21 wherein said elongated slits are oriented at an angle with respect to the axis of said elongated injector tube.

25. The low emissions combustion system of claim 21 wherein said elongated slits have sidewalls which are radially angled for tangential entry of the compressed air into said injector tube, and said elongated slits are orientated parallel to the axis of said elongated injector tube.

26. The low emissions combustion system of claim 20 wherein said plurality of openings in said elongated injector tube includes at least one row of holes.

27. The low emissions combustion system of claim 26 wherein the number of rows of a plurality of holes is two and the holes of adjacent rows are offset.

28. The low emissions combustion system of claim 26 wherein the number of rows of a plurality of holes is three and the holes of adjacent rows are offset.

29. The low emissions combustion system of claim 26 wherein the number of rows of a plurality of holes is five and the holes of adjacent rows are offset.

30. The low emissions combustion system of claim 20 wherein said plurality of openings in said elongated injector tube includes a row of holes and a row of elongated slits.

31. The low emissions combustion system of claim 30 wherein said row of holes is upstream of said row of elongated slits.

32. The low emissions combustion system of claim 30 wherein said row of holes is downstream of said row of elongated slits.

33. The low emissions combustion system of claim 30 wherein said elongated slits have sidewalls which are radially angled for tangential entry of the compressed air into said injector tube.

34. The low emissions combustion system of claim 30 wherein said elongated slits are oriented parallel to the axis of said elongated injector tube.

35. The low emissions combustion system of claim 30 wherein said elongated slits are oriented at an angle with respect to the axis of said elongated injector tube.

36. The low emissions combustion system of claim 30 wherein said elongated slits have sidewalls which are radially angled for tangential entry of the compressed air into said injector tube, and said elongated slits are oriented parallel to the axis of said elongated injector tube.

37. The low emissions combustion system of claim 20 wherein said plurality of openings in said elongated injector tube includes at least one row of holes and in addition the discharge end of said elongated injector tube includes a vaned swirler.

38. The low emissions combustion system of claim 20 wherein each of said plurality of tangential fuel injectors includes a fuel distribution centering ring within said injector tube upstream of said plurality of openings in said injector tube, said centering ring having a sloped downstream face and including a plurality of spaced openings for the passage of fuel therethrough.

39. The low emissions combustion system of claim 38 wherein said plurality of openings in said elongated injector tube includes at least one row of holes.

40. The low emissions combustion system of claim 38 wherein said plurality of openings in said elongated injector tube includes elongated slits having sidewalls which are radially angled for tangential entry of the compressed air into said injector tube, and said elongated slits are oriented parallel to the axis of said elongated injector tube.

41. The low emissions combustion system of claim 38 wherein said plurality of openings in said elongated injector tube includes a row of holes and a row of elongated slits, with the row of holes disposed generally over the sloped downstream face of said fuel distribution centering ring and the row of elongated slits are downstream of said row of holes.

42. The low emissions combustion system of claim 18 and in addition a plurality of fuel control valves to modulate the flow of fuel to said plurality of fuel injectors, one fuel control valve associated with each of said plurality of fuel injectors.

43. The low emissions combustion system of claim 18 and in addition a plurality of fuel control valves to sequence the flow of fuel to said plurality of fuel injectors, one fuel control valve associated with each of said plurality of fuel injectors.

44. The low emissions combustion system of claim 18 and in addition a fuel control valve to control the flow of fuel to said plurality of fuel injectors.

45. The low emissions combustion system of claim 18 wherein each of said plurality of tangential fuel injectors includes a concentric inner injector tube within said outer injector tube and extending from said coupler to the discharge end of said elongated injector tube, and a fuel distribution centering ring between said concentric inner injector tube and said elongated injector tube disposed between said coupler and the discharge end of said elongated injector tube, said centering ring including a plurality of spaced openings for the passage of fuel therethrough, and said plurality of openings in said elongated injector tube are downstream of said centering ring.

46. The low emissions combustion system of claim 45 wherein the downstream face of said fuel distribution centering ring is sloped.

47. The low emissions combustion system of claim 45 wherein the discharge end of said elongated injector tube includes a swirler.

48. The low emissions combustion system of claim 47 wherein said swirler includes a plurality of vanes.

49. The low emissions combustion system of claim 45 wherein said coupler includes a pilot fuel inlet to said inner injector tube and the discharge end of said inner injector tube includes a pilot flame holder.

50. The low emissions combustion system of claim 18 wherein each of said plurality of tangential fuel injectors comprises:

an elongated injector tube having an outer end and a discharge end;

a gaseous fuel inlet tube;

a liquid fuel inlet tube; and a coupler joining the outer end of said elongated injector tube with said gaseous fuel inlet tube and said liquid fuel inlet tube, said gaseous fuel inlet tube perpendicular to said elongated injector tube and said liquid fuel inlet tube concentric with said elongated injector tube, said elongated injector tube having a plurality of openings therein intermediate said coupler and said discharge end thereof for the entry of compressed air from said angled tube into the interior of said elongated injector tube to mix with gaseous fuel from said gaseous fuel inlet or liquid fuel from said liquid fuel inlet.

51. The low emissions combustion system of claim 50 wherein the discharge end of said elongated injector tube includes a swirler.

52. The low emissions combustion system of claim 50 wherein said plurality of openings in said elongated injector tube includes at least one row of a plurality of holes.

53. The low emissions combustion system of claim 52 wherein said plurality of rows of offset holes is two and the holes of adjacent rows are offset.

54. The low emissions combustion system of claim 50 wherein said plurality of openings in said elongated injector tube includes elongated slits.

55. The low emissions combustion system of claim 51 wherein said elongated slits have sidewalls which are radially angled for tangential entry of the compressed air into said injector tube, and said elongated slits are oriented parallel to the axis of said elongated injector tube.

56. The low emissions combustion system of claim 55 wherein said elongated slits have sidewalls which are radially angled for tangential entry of the compressed air into said injector tube, and said elongated slits are oriented parallel to the axis of said elongated injector tube.

57. The low emissions combustion system of claim 50 wherein said plurality of openings in said elongated injector tube includes a row of holes and a row of elongated slits.

58. The low emissions combustion system of claim 56 wherein said row of holes is upstream of said row of elongated slits.

59. The low emissions combustion system of claim 56 wherein said row of holes is downstream of said row of elongated slits.

60. The low emissions combustion system of claim 50 wherein each of said plurality of tangential fuel injectors includes a fuel distribution centering ring within said elongated injector tube disposed between said coupler and the discharge end of said elongated injector tube, said centering ring having a sloped downstream face and including a plurality of spaced openings for the passage of fuel therethrough, and a concentric inner injector tube disposed within said outer injector tube and extending from the liquid fuel inlet of said coupler to said fuel distribution centering ring, and said plurality of openings in said elongated injector tube are downstream of said fuel distribution centering ring.

* * * * *

UNITED STATES PATENT AND TRADEMARK OFFICE
CERTIFICATE OF CORRECTION

PATENT NO : 5,850,732
DATED : December 22, 1998
INVENTOR(S) : Jeffrey W. Willis et al.

It is certified that error appears in the above-identified patent and that said Letters Patent is hereby corrected as shown below:

Column 5, line 22, before "the" insert --fuel within--

Signed and Sealed this

Fourth Day of May, 1999

*Attest:*

*Attesting Officer*

Q. TODD DICKINSON

*Acting Commissioner of Patents and Trademarks*